United States Patent [19]

Warren et al.

[11] Patent Number: 4,905,775

[45] Date of Patent: Mar. 6, 1990

[54] DRILLING SYSTEM AND FLOW CONTROL APPARATUS FOR DOWNHOLE DRILLING MOTORS

[75] Inventors: Tommy M. Warren, Coweta; James F. Brett; Warren J. Winters, both of Tulsa, all of Okla.

[73] Assignee: Amoco Corporation, Chicago, Ill.

[21] Appl. No.: 244,775

[22] Filed: Sep. 15, 1988

[51] Int. Cl.[4] ..... E21B 34/10

[52] U.S. Cl. ..... 175/38; 175/100; 166/320; 137/504

[58] Field of Search ..... 166/320, 321, 319; 175/93, 38, 107, 100; 137/504

[56] References Cited

U.S. PATENT DOCUMENTS

| | | | |
|---|---|---|---|
| Re. 30,257 | 4/1980 | Fox | 175/107 |
| 2,777,458 | 1/1957 | Stern | 137/504 |
| 3,593,742 | 7/1981 | Taylor | 137/504 |
| 4,114,703 | 9/1978 | Matson, Jr. et al. | 175/107 |
| 4,114,704 | 9/1978 | Maurer et al. | 175/107 |
| 4,187,918 | 2/1980 | Clark | 175/107 |
| 4,220,380 | 9/1980 | Crase et al. | 308/174 |
| 4,225,000 | 9/1980 | Maurer | 175/107 |
| 4,246,976 | 1/1981 | McDonald, Jr. | 175/107 |
| 4,260,031 | 4/1981 | Jackson, Jr. | 175/107 |
| 4,324,299 | 4/1982 | Nagel | 175/107 |
| 4,329,127 | 5/1982 | Tschirky et al. | 418/48 |
| 4,361,194 | 11/1982 | Chow et al. | 175/107 |
| 4,372,400 | 2/1983 | Beimgraden | 175/107 |
| 4,546,836 | 10/1985 | Dennis et al. | 175/107 |
| 4,560,014 | 12/1985 | Geczy | 175/107 |
| 4,577,704 | 3/1986 | Aumann | 175/107 |

FOREIGN PATENT DOCUMENTS

| | | | |
|---|---|---|---|
| 0141699 | 5/1980 | Fed. Rep. of Germany | 175/107 |
| 1027370 | 7/1983 | U.S.S.R. | 166/321 |

*Primary Examiner*—Jerome W. Massie
*Assistant Examiner*—Terry Lee Melius
*Attorney, Agent, or Firm*—Scott H. Brown; Fred E. Hook

[57] ABSTRACT

To divert sufficient fluid flow through an unsealed bearing section of a downhole drilling motor, a flow control apparatus is provided for insertion between the power section of the motor and the bottom of a drill bit which is to be turned by the motor. The flow control apparatus includes a variable flow channel having a selectable effective cross-sectional area preferably embodied by a valve. A selected effective cross-sectional area is chosen by a control mechanism, such as a snap ring or a spring used to control the position of a valve member of the valve in response to different flow rates of fluid pumped through the valve depending upon whether the drill bit is on-bottom or off-bottom. In one embodiment the apparatus is incorporated within the interior of a drill bit which has angled flow channels to direct flushing fluid flow to side wall locations where reaming occurs. Flow through these outlets is controlled by positioning of the valve member. The flow control apparatus is part of a borehole excavating apparatus which is a part of a system for drilling a borehole.

7 Claims, 4 Drawing Sheets

DRILLING SYSTEM AND FLOW CONTROL APPARATUS FOR DOWNHOLE DRILLING MOTORS

BACKGROUND OF THE INVENTION

1. Field Of the Invention

This invention relates to a system for drilling a borehole utilizing a downhole drilling motor, and more particularly, but not by way of limitation, to an apparatus for controlling the flow of fluid through a downhole drilling motor specifically to maintain adequate fluid flow through an unsealed bearing section of the downhole drilling motor.

2. Setting of the Invention

To drill an oil or gas well, for example, a drill bit is rotated against the earth at a preselected location to form a borehole intersecting one or more formations which hopefully contain oil or gas. One way to rotate the drill bit is to apply a rotary force at the surface and transmit it through the entire drill string extending from the surface to the bottom of the borehole where the drill bit is located. Another technique is to locate a motor, referred to as a downhole drilling motor, near the lower end of the drill string and to create there a more localized rotary force by pumping drilling fluid through the downhole drilling motor. This precludes having to turn the entire drill string as would be done in the first-mentioned technique.

Downhole drilling motors are well known in the art (see, for example, "Background of the Invention" section in U.S. Pat. No. 4,114,703 to Matson, Jr., et al.). For present purposes, it is sufficient to note that a downhole drilling motor typically has a rotatable drive shaft journaled in bearings. One problem which has resulted from this construction is how to maintain adequate lubrication and cooling of the bearings to prevent premature failure.

One type of downhole drilling motor which tries to maintain adequate lubrication and cooling of its bearings utilizes a sealed bearing chamber filled with lubricant. See U.S. Pat. No. 4,114,703 to Matson, Jr., et al.; U.S. Pat. No. 4,114,704 to Maurer et al.; U.S. Pat. No. 4,225,000 to Maurer; U.S. Pat. No. 4,246,976 to McDonald, Jr.; U.S. Pat. No. 4,324,299 to Nagel; U.S. Pat. No. 4,329,127 to Tschirky et al.; U.S. Pat. No. 4,361,194 to Chow et al.; U.S. Pat. No. 4,372,400 to Beimgraben; and U.S. Pat. No. 4,577,704 to Aumann.

Another type of downhole drilling motor includes an unsealed bearing section through which drilling fluid is to be flowed to try to maintain adequate bearing lubrication and cooling. It is this type of motor with which the present invention is concerned.

The bearings in this "unsealed" type of downhole drilling motor are cooled and lubricated by porting a small fraction (for example, 5–10%) of the drilling fluid through the bearing section of the motor (one flow restrictor construction is shown in U.S. Pat. No. 4,220,380 to Crase et al.). The flow through the unsealed bearing section constitutes a parallel branch of a flow circuit which also includes a main branch typically defined through a drive shaft of the motor and a drill bit connected to the drive shaft. Because the branches are in fluid parallel, the pressure drop across each is the same. Thus, for a given pressure drop, the volume of fluid ported through the bearings is a function of the clearance (that is, effective minimum cross-sectional flow area) in the bearings branch and the clearance in the bit branch.

There is a minimum flow rate that is required to adequately lubricate and cool the bearings in a given downhole drilling motor having an unsealed bearing section. For example, in one type of motor, this flow rate might be achieved when the bit branch pressure drop is about 200 pounds per square inch. If the motor bearings are operated at less than whatever the minimum flow rate is, such as by having too small of a bit pressure drop, the motor bearings will not be adequately lubricated and cooled and will likely fail prematurely.

When operating a downhole drilling motor and a connected drilling bit with the bit off-bottom, it is common practice such that the overall flow rate of the drilling fluid through the drill string is frequently less than when the bit is on-bottom. Also, the branch pressure drop is normally much lower than the minimum pressure needed to divert a sufficient portion of the lower flow rate to lubricate and cool the motor bearings. It is also common practice to utilize in conjunction with downhole motors drag-type drill bits wherein when the bit is off-bottom, there is less restriction within the bit branch flow passage passing through the drive shaft of the motor and on through the drill bit so that a larger percentage of the flow may go through this passage than would occur with the bit on-bottom. This greater flow through the bit branch reduces the flow through the bearing section branch of the fluid circuit. This can be a typical operating condition during a reaming operation. When this occurs, and assuming the drop in flow through the bearing section is large enough, the motor bearings would be run with inadequate lubrication.

Three alternatives exist in such a situation as is brought about in, for example, reaming: (1) trip the drill string and drill bit out of the borehole and ream without the downhole drilling motor; or (2) stay in the hole with the bit off-bottom, run the motor, and risk damaging the bearings; or (3) do something to try to maintain adequate flow through the bearing section. Two specific proposals for trying to maintain adequate pressure or flow are disclosed in U.S. Pat. No. 4,546,836 to Dennis et al. and U.S. Pat. No. 4,560,014 to Geczy. One way of trying to maintain adequate flow which is known to have been used is to run a fixed orifice pressure restrictor between the bit and motor to assure that the pressure drop across the bearings is always adequate.

Of the aforementioned three options, the first is normally not chosen because of economic constraints. That is, it is typically too time-consuming and thus expensive to trip out of the hole. The third option is preferred; but where it has been attempted by using a fixed orifice, it has been undesirable because a fixed orifice wastes hydraulic energy that may be needed to run the motor. As a result, the second option is typically used, whereby premature failures are more likely to occur.

Therefore, within the overall context of a system for drilling a borehole, but specifically with reference only to such a system incorporating a downhole drilling motor having an unsealed bearing section, there is the particular need for an economic flow control apparatus which is variable in that it will constrict the primary flow through the "bit branch" of a motor and a connected drill bit as needed to divert flow through the "bearing branch" (such as when operating off-bottom during reaming) but will allow normal flow therethrough when needed (such as when operating on-bottom). Such an apparatus should be adaptable for connection in-line with existing motors and bits so that redesign or remanufacture of motors and bits is not needed. Where redesign or remanufacture is considered, however, it would be desirable for such a flow control apparatus to be adaptable for incorporation within another component, such as the drill bit. Such a flow control apparatus could be operable one time downhole, but resettable at the surface; or it could be automatically operable and resettable downhole in response to fluid pressure or fluid flow. Although such broad concepts as in-line connection or one-time operability or repetitive resettability individually are not novel, they would be desirable features of a novel and improved flow control apparatus (see, in-line connection within the context of a sealed bearing section downhole drilling motor suggested in U.S. Pat. No. 4,225,000 to Maurer at column 11, line 43 to column 12, line 14; and a resettable dump valve responsive to fluid pressure disclosed in U.S. Pat. No. 4,372,400 to Beimgraben).

SUMMARY OF THE INVENTION

The present invention is contemplated to overcome the foregoing deficiencies and meet the above-described needs. For accomplishing this, the present invention provides a novel and improved system for drilling a borehole and a novel and improved apparatus for controlling the flow of fluid through a downhole drilling motor which includes a first flow passage and a second flow passage communicating with the first flow passage.

The system for drilling a borehole comprises a borehole excavating apparatus, hoist means for lowering and raising the borehole excavating apparatus relative to a bottom of the borehole, and pump means for pumping fluid down the borehole excavating apparatus at a selectable flow rate. The borehole excavating apparatus includes a downhole drilling motor which includes a power section with a rotatable drive member having a lower end. The downhole drilling motor also includes an unsealed bearing section including bearings supporting the drive member. The borehole excavating apparatus further includes a drill bit. The borehole excavating apparatus still further includes valve means, connected to the lower end of the drive member and to the drill bit, for causing at least a portion of a fluid flowing through the downhole drilling motor to be diverted through the unsealed bearing section and to have at least a predetermined minimum flow rate therethrough when the hoist means holds the drill bit off the bottom of the borehole and the pump means pumps fluid through the borehole excavating apparatus at an off-bottom flow rate which is not greater than a predetermined fraction of an on-bottom flow rate delivered by the pump means when the hoist means lowers the borehole excavating apparatus so that the drill bit is on the bottom of the borehole.

The valve means is one embodiment of the apparatus for controlling the flow of fluid through a downhole drilling motor. As more broadly comprehended by the present invention, this apparatus comprises: variable flow channel means for providing a variable flow channel, having a selectable effective cross-sectional area, in communication with the first flow passage of the downhole drilling motor; and control means for controlling the variable flow channel means so that the variable flow channel has a selected effective cross-sectional area characterized to cause at least a predetermined minimum flow of the fluid to occur through the second flow passage which extends through the unsealed bearing section of the downhole drilling motor.

It is contemplated that the drilling system and apparatus of the present invention are particularly useful for drilling wells with downhole drilling motors having unsealed bearing sections so that premature bearing failures are reduced or prevented, thereby reducing or preventing increased drilling time and costs otherwise brought about by such motor failures.

DETAILED DESCRIPTION OF PREFERRED EMBODIMENTS

Figure 1:
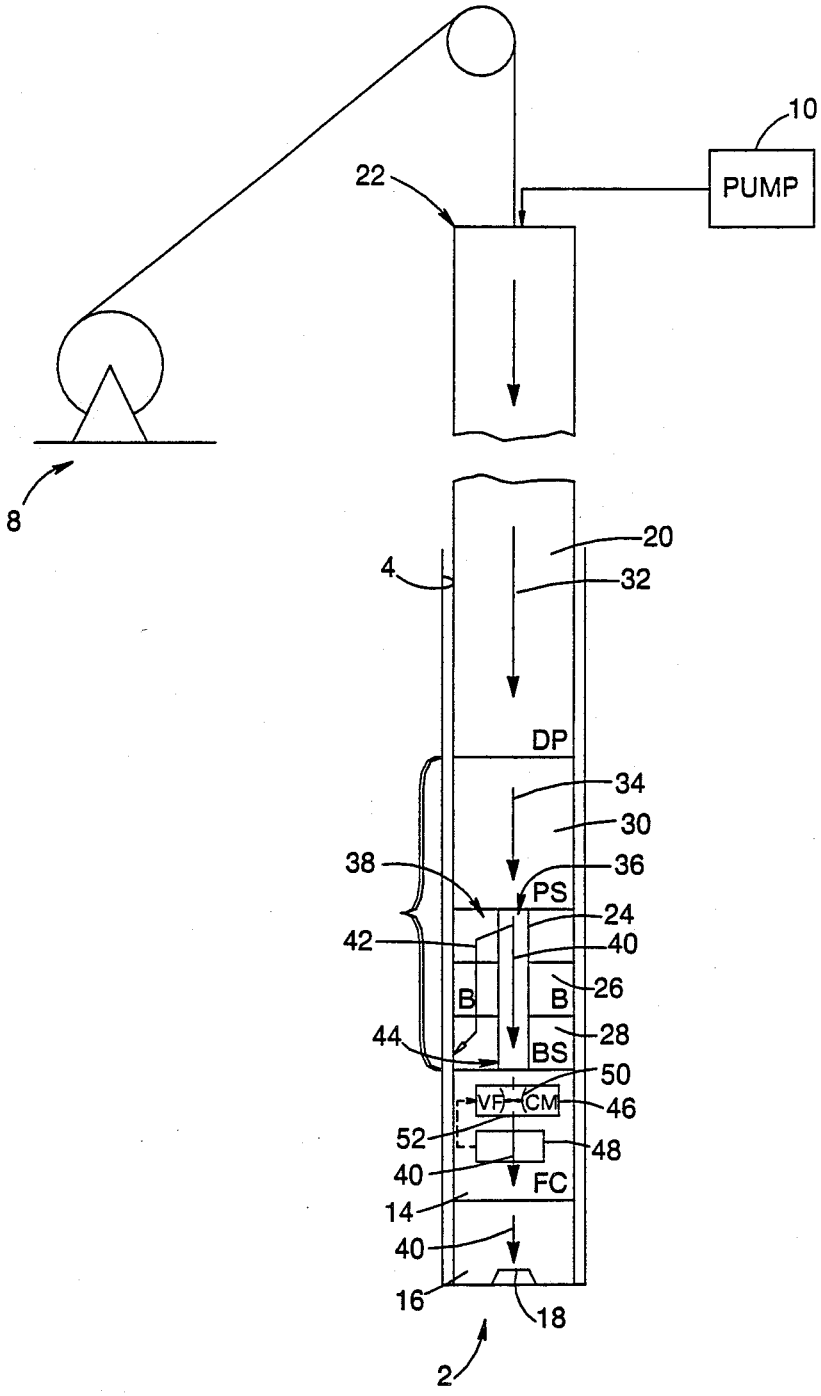
FIG. 1 is a schematic and block diagram of a borehole drilling system incorporating a flow control apparatus of the present invention.

The present invention provides a system for drilling a borehole. The present invention also provides an apparatus for controlling the flow of fluid through a downhole drilling motor, which apparatus is part of the drilling system of the present invention.

The drilling system further includes a borehole excavating apparatus (a part of which is the aforementioned flow control apparatus); the hoist means for lowering and raising the borehole excavating apparatus relative to a bottom of the borehole; and pump means for pumping fluid down the borehole excavating apparatus at a selectable flow rate.

The borehole excavating apparatus includes a downhole drilling motor which includes a power section and an unsealed bearing section. The power section includes a rotatable drive member having a lower end, and the unsealed bearing section includes bearings supporting the drive member. The borehole excavting apparatus further includes a drill bit. The borehole excavating apparatus also includes the flow control apparatus.

In a particular embodiment the flow control apparatus comprises valve means, connected to the lower end of the drive member of the power section of the downhole drilling motor and to the drill bit, for causing at least a portion of a fluid flowing through the downhole drilling motor to be diverted through the unsealed bearing section and to have at least a predetermined minimum flow rate therethrough when the hoist means holds the drill bit off the bottom of the borehole and the pump means pumps fluid through the borehole excavating apparatus at an off-bottom flow rate which is not greater than a predetermined fraction of an on-bottom flow rate delivered by the pump means when the hoist means lowers the borehole excavating apparatus so that the drill bit is on the bottom of the borehole. The flow control apparatus more broadly comprises: variable flow channel means for providing a variable flow channel, having a selectable effective cross-sectional area, in communication with a flow passage of the downhole drilling motor; and control means for controlling the variable flow channel means so that the variable flow channel has a selected effective cross-sectional area characterized to cause at least a predetermined minimum flow of the fluid to occur through the second flow passage.

Referring now to the drawings, the preferred embodiments of the aforementioned drilling system and flow control apparatus will be described. A description of the drilling system, including a general description of the flow control apparatus, will first be given with reference to FIG. 1, after which preferred embodiments of the flow control apparatus will be described with reference to FIGS. 2–7.

The system for drilling a borehole of the present invention is depicted in FIG. 1. The drilling system comprises a borehole excavating apparatus 2 which cuts earthen formations to form a borehole 4 having a bottom 6. The borehole excavating apparatus 2 will be more particularly described hereinbelow.

The drilling system of FIG. 1 also includes hoist means 8 for lowering and raising the borehole excavating apparatus 2 relative to the bottom 6 of the bore-hole 4. The hoist means 8 of the preferred embodiment includes conventional equipment well-known to the art; therefore, it will not be further described.

The drilling system shown in FIG. 1 also includes pump means 10 for pumping fluid down the borehole excavating apparatus 2 at a selectable flow rate. The pump means 10 of the preferred embodiment also includes conventional equipment well known in the art so that it will not be further described.

The borehole excavating apparatus 2 is conventionally connected with the hoist means 8 and the pump means 10. The borehole excavating apparatus includes a downhole drilling motor 12, a flow control apparatus (FC) 14, and a drill bit (DB) 16. The downhole drilling motor 12 and the flow control apparatus 14 will be more particularly described herein below. As for the drill bit 16, it can be any suitable ground engaging implement, such as a conventional diamond drill bit. The drill bit 16 can be an implement modified to contain the flow control apparatus 14 as will be more particularly described herein below. For a conventional drill bit, it would typically be one having one or more ports 18 through which fluid can be ejected, such as for scouring the bottom 6 of the bore-hole 4 or for flushing cuttings up the annulus between the borehole excavating apparatus 2 and the borehole 4.

The borehole excavating apparatus 2 is carried on longitudinally connected drill pipes (DP) 20 to form a drillstring 22. The drillstring 22 is moved in conventional fashion by the hoist means 8. Drilling fluid, such as of a conventional type, is pumped through the drillstring 22 by the pump means 10 in known fashion.

Still referring to the preferred embodiment of the drilling system depicted in FIG. 1, the downhole drilling motor 12 is a conventional, unsealed-bearing-section type of fluid-actuated drilling motor, such as a turbodrill motor or a positive displacement motor. Both of these types are well-known to the art. For purposes herein, the downhole drilling motor 12 includes a rotatable drive member 24. Specifically, the member 24 is a drive shaft supported and journaled in bearings (B) 26 (typically, both radial and thrust bearings of conventional types) of a bearing section (BS) 28 of the motor 12. For the present invention, the bearing section 28 is unsealed with respect to fluid pumped down the drill string 22. The drive member 24 is rotated by drilling fluid flowing through a power section (PS) 30 of the motor 12 in a known manner. In the FIG. 1 illustration the power section 30 is disposed above the bearing section 28.

The power section 30 is connected opposite the bearing section 28 to a drill pipe 20 as depicted in FIG. 1. As is well-known, the drill pipe 20 is a tubular member through which drilling fluid is pumped by the pump means 10. A flow of such fluid through the drill pipes 20 connected within the drill string 22 is indicated by the arrows 32. The total flow 32 enters and flows through the power section 30 as represented by the arrow 34. Thus, the full flow pumped through the drill pipes 20 by the pump means 10 is provided for rotating the drive member 24 which is connected to a rotor (not shown) of the power section 30.

The drilling fluid flows from the power section 30 into the bearing section 28 where the flow splits between a fluid flow passage 36 and a fluid flow passage 38. The flow passage 36 is defined through the drive member 24 which is typically a hollow, tubular member. Flow through this passage is indicated by the arrow 40. The flow passage 38 includes that portion of the bearing section 28 where the bearings 26 are located so that the flow (indicated by the arrow 42) through the passage 38 comes into contact with the bearings 26 to lubricate and cool them. The flow passage 38 communicates with the flow passage 36 as indicated by the coupled arrows 40, 42. Most of the flow typically is through the flow passage 36, but with enough flow through the passage 38 to lubricate and cool the bearings 26 adequately (an example of a typical split is 90% of the total flow through the passage 36 and 10% of the total flow through the passage 38).

In conventional operation, a drill bit is connected to the lower end of the drive member 24 so that when the drive member 24 is rotated so is the drill bit. In such conventional operation, the downhole drilling motor 12 is typically operated either in a bit-on-bottom mode or a bit-off-bottom mode. In the former, drilling fluid is pumped at what will be defined as a maximum flow rate. The portion of the resultant flow which would travel through the passage 36 within the drive member 24 would be somewhat impeded at the bottom of the drill bit due to the blocking effect of the bottom of the borehole being adjacent the bottom of the drill bit. This typically yields sufficient pressure drop across the parallel fluid circuits defined by the flow passages 36, 38 to divert sufficient flow through the passage 38 to lubricate and cool the bearings 26 adequately. During operation in a bit-off-bottom mode, the pressure drop across the parallel fluid circuit flow passages 36, 38 is reduced due to losing the blocking effect of the bottom of the borehole. The pump flow rate is also typically reduced to either a relatively low flow condition or an intermediate flow condition (the latter typically occurring when reaming is to be done). These reductions in pressure drop and flow rate can produce, in conventional usage, inadequate flow through the passage 38 thereby insufficiently lubricating and cooling the bearings 26 so that premature failure of the bearings 26 and thus of the motor 12 can occur. It is this problem which can occur in bit-off-bottom operation that is compensated for by the flow control apparatus 14 of the present invention, which flow control apparatus 14 is connected to a lower end 44 of the drive member 24 as illustrated in FIG. 1.

As generally depicted in FIG. 1, the flow control apparatus 14 includes variable flow channel means (VFCM) 46 and control means (CM) 48. The variable flow channel means 46 provides a variable flow channel 50 which is in communication with the flow passage 36 of the down-hole drilling motor 12 so that the flow 40 enters and flows through the apparatus 14 as indicated by use of the same reference numeral 40 (which flow exits the apparatus 14 and flows on through the drill bit 16 as indicated by use of the same reference numeral 40). The variable flow channel 50 has a selectable effective cross-sectional area 52. The control means 48 controls the variable flow channel means 46 so that the variable flow channel 50 has a selected effective cross-sectional area. The selected area is characterized as that area which causes at least a predetermined minimum flow of fluid to occur in the flow passage 38. The "predetermined minimum flow" is an adequate lubricant flow and is based upon the design of a particular downhole drilling motor as would be readily apparent or discernible to those skilled in the art.

As will be identified and further described hereinbelow with reference to FIGS. 2–7, the variable flow channel means 46 of the preferred embodiments shown therein includes a valve means, and the control means 48 thereof includes retaining means. Broadly, the valve means, which is connected to the lower end 44 of the drive member 24 and to the drill bit 16, causes at least a portion of a fluid flowing through the downhole drilling motor 12 to be diverted through the unsealed bearing section 28 and to have at least a predetermined minimum flow rate therethrough when the hoist means 8 holds the drill string 22 so that the drill bit 16 is off the bottom 6 of the borehole 4 and the pump means 10 pumps fluid through the borehole excavating apparatus 2 at an off-bottom flow rate which is not greater than a predetermined fraction of an on-bottom flow rate delivered by the pump means 10 when the hoist means 8 lowers the borehole excavating apparatus 2 so that the drill bit 16 is on the bottom 6 of the borehole 4. Typically the on-bottom flow rate is a maximum flow rate which is used, whereas the off-bottom flow rate is something less (i.e., a fraction less than 1 thereof). The retaining means is, broadly, for retaining a valve member of the valve means at a fixed position relative to a valve seat of the valve means until the pump means 10 pumps fluid down the borehole excavating apparatus 2 at a flow rate greater than the predetermined fraction of the on bottom flow rate.

Figure 2:
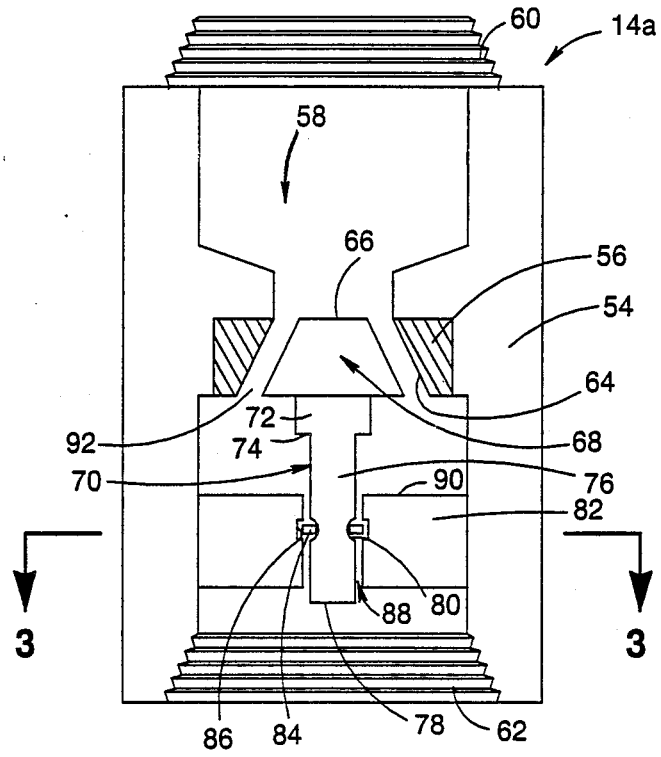
FIG. 2 is a schematic sectional elevational view of one embodiment of a flow control apparatus of the present invention.
Figure 3:
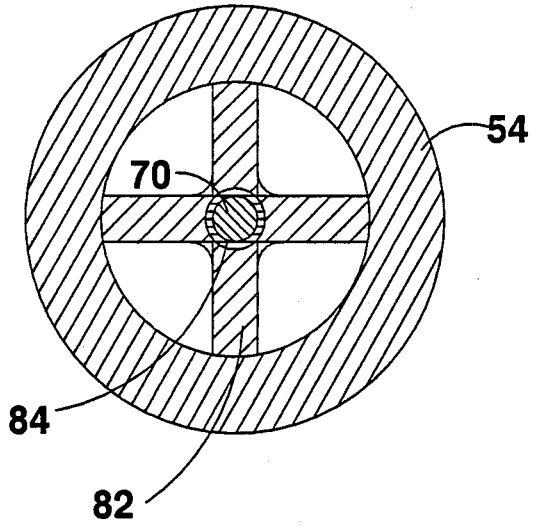
FIG. 3 is a schematic sectional view taken along line 3—3 shown in FIG. 2.

A preferred embodiment of the flow control apparatus 14 is schematically illustrated in FIGS. 2 and 3. This embodiment is generally identified by the reference numeral 14*a*. This embodiment 14*a* includes the aforementioned valve means of the variable flow control means 46 and the retaining means of the control means 48.

The valve means of the embodiment shown in FIGS. 2 and 3 includes a cylindrical support body 54 which can be referred to as a valve seat body because it supports a valve seat 56 retained within a longitudinal (specifically, axial) opening 58 extending through the length of the body 54. The body 54 has an upper threaded end 60 and a lower threaded end 62 for connecting with the lower end 44 of the drive member 24 and the upper end of the drill bit 16, respectively. With the body 54 so connected intermediate the power section 30 of the downhole drilling motor 12 and the bottom of the drill bit 16, the opening 58 is placed in fluid communication with the fluid passage 36 of the drive member 24 and the fluid passage of the drill bit 16 communicating with the port or ports 18.

The valve seat 56 has an internal frusto-conical surface 64 which defines a frusto-conical opening through the valve seat 56 as part of the opening 58. Disposed in operative association with the valve seat 56 and the surface 64 is a valve member 66 which forms another part of the valve means of the variable flow channel means 46.

The valve member 66 includes a frusto-conical valve trim or valve head 68 mounted on top of a valve stem 70. The valve stem 70 has an outer cylindrical surface 82 at the bottom of which an annular surface 74 extends radially inwardly to the top of a cylindrical surface 76. Intermediate this upper end of the surface 76 and a lower end of the surface 76 where an end surface 78 of the valve stem 70 is, there is defined a circumferential notch or groove 80.

The valve member 66 is retained and guided within the body 54 by the retaining means which in the embodiment 14*a* includes a snap ring support 82 and a snap ring 84 held in a groove 86 defined circumferentially around an axial opening 88 through the snap ring support 82.

The snap ring support 82 is defined so that flow channels are defined therethrough. For example, the support 82 can be defined by an open spider configuration as best seen in FIG. 3. This is welded to, or otherwise connected with, the support body 54.

The snap ring 84 is used to retain the valve member 66 in the position illustrated in FIG. 2. This is done by pressing the lower portion of the valve stem 70 downwardly through the snap ring 84 held in the snap ring support 82 until the groove 80 of the valve stem 70 aligns with the snap ring 84 whereupon the snap ring 84 moves inwardly into the groove 80 as pictured in FIG. 2. The snap ring 84 holds the valve member 66 at this position until a fluid is flowed at a rate above a predetermined flow rate through the flow passage 36 and the opening 58. The predetermined flow rate is that rate at which the fluid exerts a sufficient force on the valve member 66 to overcome the retaining or holding force exerted by the snap ring 84. When this retaining or holding force is exceeded, the snap ring 84 expands so that the valve stem 70 is pushed through the snap ring 84 by the flowing fluid. This downward movement of the valve member 66 can continue until the surface 74 of the valve stem 70 engages an upper surface 90 of the snap ring support 82.

When the snap ring 84 holds the valve member 66 in the upper position illustrated in FIG. 2, this holds the valve member 66 relative to the valve seat 56 so that the opening 58 (and particularly the opening through the valve seat 56 defined by the surface 64) is restricted to present an increased resistance to flow to the portion of the fluid flowing through the fluid passage 36 and the opening 58. This diverts fluid into the flow passage 38 to maintain the flow 42 at an adequate level to lubricate and cool the bearings 26. That is, the restriction or constriction imposed by the positioning of the valve member 66 shown in FIG. 2 is designed to maintain at least a minimum desired flow of fluid through the bearing section 28 of the downhole drilling motor 12. This constricted area is defined between the surface 64 and the valve trim 68 and is identified in FIG. 2 by the reference numeral 92. This is the position to be used when the hoist means 8 holds the drill string 22 so that the drill bit 16 is off-bottom, such as during a reaming operation.

When the flow rate of the fluid pumped through the passage 36 and the opening 58 is sufficiently high (i.e., above the holding force of the snap ring 84), the valve member 66 is pushed downwardly to its lowermost position as limited by the snap ring support 82. This produces less of a restriction to the opening 58. This is the preferred position of the valve member 66 during normal on-bottom drilling.

From the foregoing, it is apparent that with the valve member 66 in the position shown in FIG. 2, the flow channel defined through the opening 58 has a smaller effective minimum cross-sectional area than exists when the valve member 66 is in its lowermost position. When designed to the proper size for particular equipment as can be readily done by those skilled in the art, this creates a large enough pressure drop to divert an adequate amount of fluid into the bearing flow passage 38.

Thus, the embodiment **14*a* provides a simple device which can be run above the drill bit 16 to provide a high pressure while reaming with the drill bit 16 off-bottom and yet allow normal pressure while drilling with the drill bit 16 on-bottom; in either event, adequate fluid flow through the bearing section 28 is provided. For a specific configuration of the embodiment shown in FIG. 1, the valve seat 56 and the valve member 66 could be sized so that the pressure drop created with the valve member 66 in the upper position shown in FIG. 2 is sufficient to lubricate and cool the bearings at 75% of the normal flow rate which would be used with the drill bit 16 on-bottom and the valve member 66 in its lowermost position wherein the valve member surface 74 abuts the surface 90 of the snap ring support 82. Once the valve member 66 is in this lowermost position, it would need to be reset at the surface after the drill string 22 had been pulled out of the borehole. That is, the snap ring 84 holds the valve member 66 at its upper position only until a high enough flow rate occurs, after which the snap ring 84 expands to thereby release the valve member 66** for movement to its lowermost position where it stays until reset. The flow rate at which this occurs is determined based upon specific equipment as readily apparent to those skilled in the art.

Figure 4:
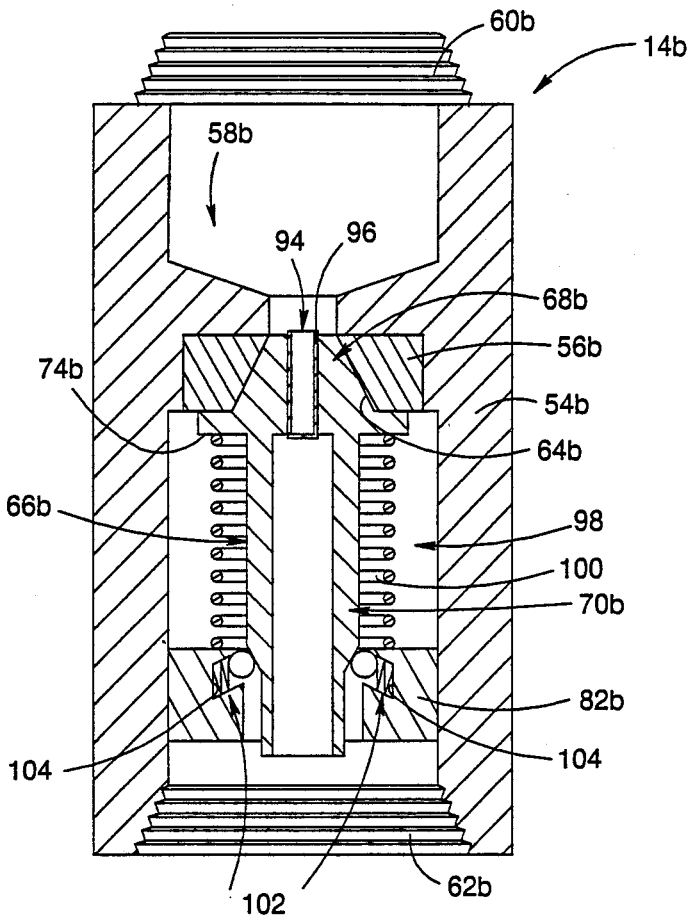
FIG. 4 is a schematic sectional elevational view of another embodiment of a flow control apparatus of the present invention.

A second embodiment of the flow control apparatus 14 is schematically illustrated in FIG. 4 and designated by the reference numeral **14*b*. This embodiment is intended to work similarly to the embodiment shown in FIGS. 2 and 3 except that the embodiment 14*b* is intended to reset automatically when the flow through the passage 36 and the opening 58 is reduced below a preset value, such as 90% of normal flow, for example. Thus, the embodiment 14*b* has the advantage of continually providing adequate lubrication and cooling for the bearing 26 during repeated changes in flow, such as during alternated on-bottom and off-bottom operations. It is, however, more complicated and, thus, possibly less reliable than the FIG. 2** embodiment.

The flow control apparatus **14*b* has the same general valve means as described hereinabove with reference to the embodiment 14*a* shown in FIGS. 2 and 3 (as indicated by the use of like reference numerals followed by the letter "b"), but for two exceptions. One exception is that the valve means is configured to cooperate with a different control or retaining means to be described hereinbelow. The other exception is that the valve member has an aperture 94** defined therethrough.

The aperture 94 is defined in the embodiment shown in FIG. 4 by a replaceable nozzle 96 suitably retained within an axial port defined through the valve trim or head **68*b*. The nozzle 96 is sized to cause the valve stem 66*b* to move downwardly, or "open", when a suitable predetermined flow rate is exceeded (for example, 90% of full flow). The aperture 94 passes fluid through the valve member 66*b* when the valve member 66*b* is in its upper position illustrated in FIG. 4 and a fluid is flowed through the passage 36 and the opening 58**.

To implement the automatic reset feature of the embodiment **14*b* the retaining means of this embodiment includes means 98 for repetitively moving the valve member 66*b* between its lower and upper positions in response to repetitively changing the flow of fluid between the upper and lower flow rates. In the FIG. 4 embodiment, this is implemented by biasing means for biasing the valve member 66*b* toward its upper position illustrated in FIG. 4. The biasing means of the FIG. 4 embodiment includes a return spring 100 supported relative to the valve seat 56*b* and engaging the valve member 66*b*. As shown, the spring 100 is particularly disposed between a surface 90*b* of a support 82*b* and the annular surface 74*b* of the valve member 66*b*. The spring 100** is a compression spring.

The biasing means also includes locking ball and spring means 102 for releasably retaining the valve member **66*b* in its upper position illustrated in FIG. 4. The locking ball and spring means 102 includes spring and ball elements received in cavities 104 defined within the support 82*b***.

Assuming that the nozzle 96 is sized to cause downward operation of the valve member **66*b* at 90% of the full rate of flow, then at flow rates below 90% all the fluid flowing through the passage 36 and the opening 58*b* will be ported through the nozzle 96, which is also sized in a specific example to give sufficient pressure drop to lubricate and cool the bearings even at 75% of full flow. At such flow rate below 90% of rated flow, the valve member 66*b* is kept seated against the valve seat 56*b* by proper sizing of the return spring 100 and the locking ball and spring means 102**.

When the flow rate of the fluid flowing through the passage 36 and the opening **58*b* exceeds the predetermined rate (i.e., 90% in this example), the force from the flowing fluid acting downwardly on the valve body 66*b* overcomes the forces of the spring 100 and the locking ball and spring means 102 so that the valve means is then opened. The locking balls are pushed back in their respective recesses 104 so that they do not provide any further resistance to the motion of the valve. The valve means will remain open until the force of the return spring 100 exceeds the force of the flowing fluid acting downwardly on the valve member 66*b***.

Figure 7:
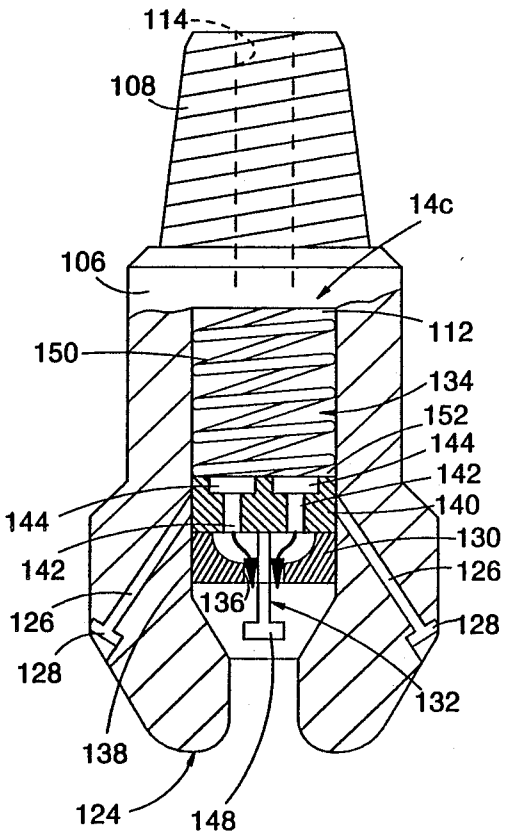
FIGS. 5–7 are schematic sectional elevational views of still another embodiment of a flow control apparatus of the present invention wherein three different positions of operation are illustrated.
Figure 6:
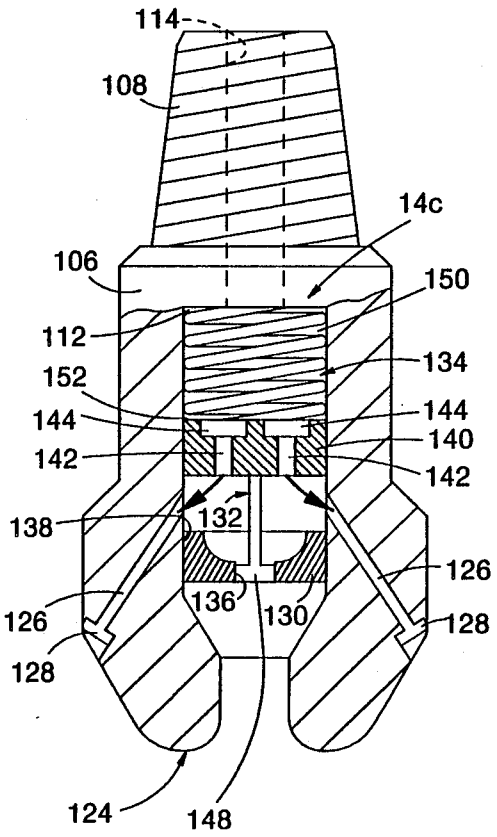
Figure 5:
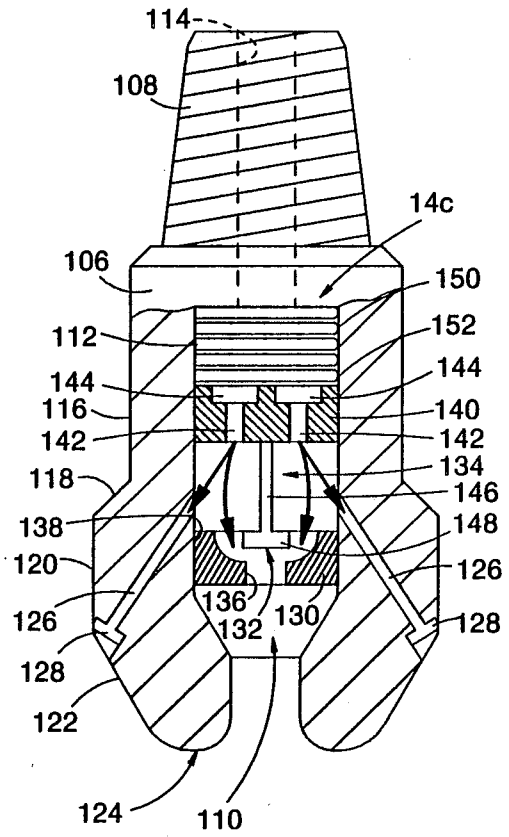

A third embodiment, generally designated by the reference numeral **14*c* of the flow control apparatus 14 is shown in FIGS. 5–7. This embodiment is contained within the interior space that is normally provided within a diamond drill bit 106. As in the previously described embodiments, a sliding valve produces sufficient back-pressure at reduced flow rates (such as during reaming) to maintain adequate fluid flow through the bearing section 28 of the downhole drilling motor 12. The valve moves to a "full-open" configuration at higher flow rates used for on-bottom drilling. Different positions are shown in FIGS. 5, 6 and 7**, respectively, as will be more particularly described hereinbelow.

As in the embodiment shown in FIG. 4, the valve means of the embodiment shown in FIGS. 5–7 automatically resets downhole for multiple reaming and drilling cycles. Unlike the other described embodiments, however, the valve of the embodiment **14*c* also diverts fluid to the periphery of the drill bit 106** where hydraulic energy is most needed while reaming, thus making this embodiment applicable to all drilling situations with diamond bits regardless of whether a downhole drilling motor is in use.

The diamond drill bit 106 has a pin end 108 which connects directly to the lower end 44 of the drive member 24. The flow control apparatus **14*c* is maintained intermediate the downhole drilling motor 12 and the bottom of the drill bit 106 by being carried within a cavity 110 defined within the body of the drill bit 106. The cavity 110 extends downwardly from a support surface 112 disposed below the pin end 108. An axial bore 114 is defined through the pin end 108 and the support surface 112**.

The main body of the bit 106 has a cylindrical outer surface 116 at the bottom of which an angled surface 118 extends. Below the surface 118 a cylindrical surface 120 extends, tapering along a surface 122 to a nose 124 of the bit 106. The surface 116 is part of the shank of the bit 106, and the surface 120 defines a maximum outer diameter or gauge of the bit 106.

Defined angularly through the body of the bit 106 from the cavity 110 to the bit's outer shoulder at the junction of the surfaces 120, 122 are a plurality of reaming fluid outlets or channels 126. Each outlet 126 includes a replaceable reaming jet nozzle 128. The outlets 126 are angled in outward and downward directions relative to their inlets adjoining the cavity 110 so that fluid is ejected therefrom in a direction towards where the bit 106 contacts the rock during a reaming operation.

Mounted within the cavity 110 of the drill bit 106 is the valve means of the embodiment **14*c*. This valve means includes a valve seat body 130 and a valve member 132**.

The valve seat body 130 is disposed in the cavity 110 so that a chamber 134 is defined within the cavity 110 between the support surface 112 and the valve seat body 130. The body 130 has a valve seat 136. The body 130 has a stop means defined by an upper surface 138. The body 130 is connected by any suitable means, such as by welding or by being integrally formed to the drill bit 106.

The valve member 132 is slidably disposed in the cavity 110 in operative association with the fluid outlets 126 and the valve seat body 130. The valve member 132 includes a piston 140 which is slidably disposed within the chamber 134 as shown in FIGS. 5–7. The piston 140 has a plurality of longitudinally extending apertures 142 in which replaceable piston jet nozzles 144 are mounted. These allow fluid flow through the piston 140 in a manner analogous to that of the valve member **66*b* in the FIG. 4 embodiment, and thus assist in the position control of the valve member 132. The piston 140 has an outer diameter substantially equal to the inner diameter of the chamber 134 so that the piston 140 blocks the inlets to the fluid outlets 126 when the piston 140** is aligned therewith.

Extending from and below the piston 140 is a valve stem 146 terminating in a valve trim or head 148. The valve stem 146 depends from the piston 140 in such a manner that the head 148 is operatively associated with the valve seat 136 to either block or unblock it.

The control means of the embodiment **14*c* by which the positioning of the piston 140 and the connected valve stem 146 is controlled includes a tension spring 150 disposed within the cavity 110 and, more particularly, within the chamber 134 between the support surface 112 and an upper surface 152 of the piston 140, as shown in FIGS. 5–7. The spring 150 has an upper end adjacent and engaging the surface 112 and a lower end adjacent and engaging the surface 152. The spring 150 operates analogously to the spring 100 of the FIG. 4 embodiment (except that one has the compression spring and the other is a tension spring) in that the spring 150 likewise provides a biasing means which repetitively moves the valve member 132 between or among its operative positions in response to repetitively changing flow rates of fluid. By adjusting such flow rates, the valve member 132 is moved from its "low flow" position in FIG. 5 to its "reaming" position shown in FIG. 6 and its "drilling" position shown in FIG. 7**.

During "low flow" position operation wherein a low flow rate of fluid is being pumped (such as below 75% of full normal flow rate), the spring 150 pulls the valve member 132 to its uppermost position shown in FIG. 5. In this position, the portion of the pumped fluid flowing through the passage 36 and the bore 114 flows through the apertures 142 and out an effective cross-sectional area defined by the areas of the fluid outlets 126 and the area through the valve seat 136.

When the flow rate is increased to a rate used in reaming, such as 75–90% of full flow, the force of the fluid acting on the piston 140 partially overcomes the biasing force of the spring 150 to move the valve member 132 to its intermediate, "reaming" position shown in FIG. 6. In this position, the valve head 148 blocks flow through the valve seat 130 so that fluid flowing through the apertures 142 exits only through the effective cross-sectional area defined by the fluid outlets 126. This creates a sufficient pressure drop to divert enough of the total flow being pumped by the pump 10 through the passage 38 to lubricate and cool the bearings 26 during a reaming operation. This also ejects fluid through the nozzles 128 in a direction to facilitate the reaming operation.

Upon full flow being applied by the pump 10 (e.g., 90–100%) the valve member 132 is moved to its lowermost position adjacent the stopping surface 138 shown in FIG. 7. In this position, the fluid outlets 126 are blocked by the piston 140 and the valve seat 136 is again opened to flow due to the lowering of the valve head 148 to the position shown in FIG. 7. This provides all of the flow which has come down through the passage 36 to exit through the cross-sectional area defined at the opened valve seat 136 and on through the nose 124 of the bit 106 to assist the drilling operation with the bit 106 on-bottom.

The following is a chart of an example computation for the embodiment shown in FIGS. 5–7.

| EXAMPLE COMPUTATION | | |
|---|---|---|
| BIT/MOTOR HYDRAULICS | | |
| GPM = GPM + GPM | ΔP = ΔP* | bit |

-continued

EXAMPLE COMPUTATION

| | total | brng | bit | brng | bit | hydraulics |
|---|---|---|---|---|---|---|
| REAMING | 220 | 25 | 194 | 713 psi @ .027 $in^2$ eff. area | 713 psi @ .210 $in^2$ with reaming jets | 2 × 12/32" jets → 297 ft/sec jet velocity |
| DRILLING | 310 | 30 | 280 | 1000 psi @ .027 $in^2$ eff. area | 1000 psi @ .255 $in^2$ with water courses | 2.9 bit HP/$in^2$ @ 280 gpm |

*referenced to 10 ppg mud

FLOW DIVERTER CHARACTERISTICS

| | ΔP across piston* | piston thrust | valve thrust | piston displacement @ 500 lb/in |
|---|---|---|---|---|
| REAMING | 57 psi @ 195 gpm | 906 lb | 45 lb | 1.90" |
| DRILLING | 118 psi @ 280 gpm | 1876 lb | 0 | 3.75"§ |

*w/2 × 22/32" jets + 10 ppg mud
assuming 1" valve w/0.785 $in^2$ area
4.5" piston 15.9 $in^2$ area
§piston hits stop prior to full 3.75" deflection Features of the embodiment shown in FIGS. 5–7 include that it is applicable with or without a downhole motor because of the fluid outlets 126 provided to assist a reaming operation. By means of the outlets 126, the embodiment of FIGS. 5–7 focuses hydraulic energy in the gauge region when reaming. Another feature is that, as with the previously described embodiments, it provides sufficient back-pressure to divert enough fluid into the passage 38 to adequately cool and lubricate the motor bearings 26 when washing and reaming off-bottom. This embodiment is in a full-open position at low flow or no flow conditions, and it fails into a normal drilling flow configuration if the spring 150 breaks. The embodiment 14c adds relatively low pressure drop (less than approximately 125 pounds/square inch) to the surface pressure. This embodiment is contemplated to be compatible with the size and geometry of standard diamond bits, and thus would require only reasonable, feasible bit manufacturing modifications. It also is field serviceable and does not interfere with performing pump-off tests. The embodiment of FIGS. 5–7 is tunable via the replaceable piston jets 144, reaming jets 128, and spring 150 to accommodate a wide range of conditions. The embodiment 14c provides positive surface pressure indication of its operational status. It is automatically resettable any number of times via flow rate adjustment, and its only movable part is the valve member 132 (although the spring 150 moves in the sense of stretching or compressing).

While presently preferred embodiments of the invention have been described herein for the purpose of disclosure, numerous changes in the construction and arrangement of parts will suggest themselves to those skilled in the art, which changes are encompassed within the spirit of this invention as defined by the appended claims.

What is claimed is:

1. An apparatus for controlling a flow of fluid through a downhole drilling motor which includes a first flow passage and a second flow passage communicating with the first flow passage extending through an unsealed bearing section of the downhole drilling motor, said apparatus comprising:

variable flow channel means for providing a variable flow channel, having a selectable effective cross-sectional area, in communication with the first flow passage of the downhole drilling motor, including a valve, comprising a valve seat body having an opening defined therethrough; and a valve member disposed in said seat body so that said valve member is movable between said first position relative to said opening wherein said flow channel is defined with a first effective cross-sectional area and a second position relative to said opening wherein said flow channel is defined with a second effective cross-sectional area; and control means for controlling said variable flow channel means so that said variable flow channel has a selected effective cross-sectional area characterized to cause at least a predetermined minimum flow of the fluid to occur through the second flow passage, said control means includes a snap ring connected to said valve seat body for holding said valve member at said first position until a fluid is flowed above a predetermined flow rate through the first flow passage of the downhole drilling motor and said opening defined in said valve seat body;

2. An apparatus as defined in claim 1, wherein said variable flow channel means includes a support body having an opening defined therethrough in which said control means is disposed, said support body including first end means for connecting to the downhole drilling motor and further including second end means for connecting to a drill bit.

3. An apparatus for controlling a flow of fluid through a downhole drilling motor which includes a first flow passage and a second flow passage communicating with the first flow passage and extending through an unsealed bearing section of the downhole drilling motor, said apparatus comprising:

variable flow channel means for providing a variable flow channel, having a selectable effective cross-sectional area, in communication with the first flow passage of the downhole drilling motor, and including a valve, comprising a valve seat body having an opening defined therethrough, and a valve member disposed in said valve seat bodies so that said valve member is movable between a first position relative to said opening wherein said flow channel is defined with a first effective cross-sectional area and a second position relative to said opening wherein said flow channel is defined with a second effective cross-sectional area; and control means for controlling said variable flow channel means so that said variable flow channel has a selected effective cross-sectional area characterized to cause at least a predetermined minimum flow of the fluid to occur through the second flow passage, including biasing means for biasing said valve member towards said first position and a return spring disposed between said valve seat body and said valve member, and locking ball and spring means for releasably retaining said valve member in said first position.

4. An apparatus as defined in claim 3, wherein said valve member has an aperture defined therethrough for passing fluid through said valve member when said valve member is in said first position and a fluid is flowed through the first flow passage of the downhole drilling motor and through said opening defined in said valve seat body.

5. An apparatus for controlling a flow of fluid through a downhole drilling motor which includes a first flow passage and a second flow passage communicating with the first flow passage and extending through an unsealed bearing section of the downhole drilling motor, said apparatus comprising:

variable flow channel means for providing a variable flow channel, having a selectable effective cross-sectional area, in communication with the first flow passage of the downhole drilling motor, and wherein said variable flow channel means is adapted for disposition in a drill bit having defined therein a cavity and fluid outlets extending from said cavity and includes a valve seat disposed in said cavity; an a valve member slidably disposed in said cavity in operative association with said fluid outlets and said valve seat so that said fluid outlets and said valve seats are unblocked by said valve member in response to said valve member in a first position and further so that said fluid outlets are unblocked but said valve seat is blocked by said valve member in response to said valve member in a second position and still further so that said fluid outlets are blocked but said valve seat is unblocked by said valve member in response to said valve member in a third position; and control means for controlling said variable flow channel means so that said variable flow channel has a selected effective cross-sectional area characterized to cause at least a predetermined minimum flow of the fluid to occur through the second flow passage.

6. An apparatus as defined in claim 5, wherein said control means includes a spring disposed within said cavity and including a first end adjacent said drill bit and further including a second end adjacent said valve member.

7. An apparatus as defined in claim 5, wherein said valve member includes:

a piston having an aperture defined therethrough, said piston disposed in said cavity in operative association with said fluid outlets; and a valve stem extending from said piston so that said valve stem is in operative association with said valve seat.

* * * * *